US011987949B2

(12) United States Patent
Brabec

(10) Patent No.: US 11,987,949 B2
(45) Date of Patent: May 21, 2024

(54) METHOD AND APPARATUS FOR MACHINE OPERATOR COMMAND ATTENUATION

(71) Applicant: Topcon Positioning Systems, Inc., Livermore, CA (US)

(72) Inventor: Vernon Joseph Brabec, Livermore, CA (US)

(73) Assignee: Topcon Positioning Systems, Inc.

( * ) Notice: Subject to any disclaimer, the term of this patent is extended or adjusted under 35 U.S.C. 154(b) by 86 days.

(21) Appl. No.: 16/113,060

(22) Filed: Aug. 27, 2018

(65) Prior Publication Data

US 2019/0063034 A1 Feb. 28, 2019

Related U.S. Application Data

(60) Provisional application No. 62/552,058, filed on Aug. 30, 2017.

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/26*** | (2006.01) |

(52) U.S. Cl.

CPC ..... *E02F 3/435* (2013.01); *E02F 3/32* (2013.01); *E02F 3/437* (2013.01); *E02F 9/2033* (2013.01); *E02F 9/262* (2013.01); *E02F 9/265* (2013.01)

(58) Field of Classification Search

CPC ... E02F 3/435–439; E02F 9/2033; E02F 9/00; E02F 9/2058–2095

USPC ..... 701/50

See application file for complete search history.

(56) References Cited

U.S. PATENT DOCUMENTS

| | | | |
|---|---|---|---|
| 2,668,062 | A | 2/1954 | Drummond |
| 3,169,650 | A | 2/1965 | Soyland |
| 3,252,605 | A | 5/1966 | Orwig et al. |
| 3,289,546 | A | 12/1966 | Erickson |
| 3,400,634 | A | 9/1968 | Wirtz |
| 3,407,946 | A | 10/1968 | Pilch |
| 3,616,940 | A | 11/1971 | Milner |

(Continued)

FOREIGN PATENT DOCUMENTS

| | | |
|---|---|---|
| DE | 112016000015 | 12/2016 |
| DE | 102017223143 A1 | 6/2019 |

(Continued)

OTHER PUBLICATIONS

Non-Final Rejection dated Dec. 7, 2021. in connection with U.S. Appl. No. 16/585,784, filed Sep. 27, 2019, 9 pgs. (Year: 2021).*

(Continued)

*Primary Examiner* — Jeffrey C Boomer
*Assistant Examiner* — Paul Allen
(74) *Attorney, Agent, or Firm* — Chiesa Shahinian & Giantomasi PC

(57) ABSTRACT

A method for machine operator command attenuation includes the step of detecting a position of a boom, stick, and bucket of a hydraulic implement of a construction machine. Movement of the stick is detected by a controller. The controller determines if the movement of the stick will cause excavation below a desired grade. If the movement will not cause excavation below a desired grade, the controller will take no action. If the movement will cause excavation below a desired grade, the controller will command the boom to raise.

11 Claims, 9 Drawing Sheets

(56) References Cited

U.S. PATENT DOCUMENTS

| | | | | |
|---|---|---|---|---|
| 3,713,557 | A | 1/1973 | Seaberg et al. | |
| 4,593,586 | A * | 6/1986 | Cudnohufsky | B23Q 35/16 82/11.5 |
| 5,524,437 | A * | 6/1996 | Larkin | F16H 39/10 60/492 |
| 5,701,795 | A * | 12/1997 | Friedrichsen | F15B 13/0417 91/446 |
| 6,047,228 | A | 4/2000 | Stone et al. | |
| 6,285,913 | B1 | 9/2001 | Haegglund | |
| 7,318,292 | B2 | 1/2008 | Helbling et al. | |
| 7,878,481 | B2 | 2/2011 | Kallfass et al. | |
| 7,975,410 | B2 | 7/2011 | Faivre et al. | |
| 9,322,149 | B2 | 4/2016 | Takaura et al. | |
| 9,404,237 | B2 | 8/2016 | Faivre et al. | |
| 9,410,305 | B2 | 8/2016 | Matsuyama et al. | |
| 9,469,969 | B2 | 10/2016 | Kanari et al. | |
| 9,540,793 | B2 | 1/2017 | Kami et al. | |
| 9,677,251 | B2 | 6/2017 | Kitajima | |
| 9,725,874 | B2 | 8/2017 | Meguriya et al. | |
| 10,975,896 | B2 * | 4/2021 | Böhm | F15B 11/046 |
| 2003/0097837 | A1 | 5/2003 | Hiraki et al. | |
| 2006/0062662 | A1 | 3/2006 | Curl et al. | |
| 2006/0104785 | A1 | 5/2006 | Vachon | |
| 2008/0162004 | A1 * | 7/2008 | Price | E02F 3/434 701/50 |
| 2008/0203372 | A1 | 8/2008 | Ellefson et al. | |
| 2009/0107016 | A1 | 4/2009 | Hill | |
| 2009/0234508 | A1 | 9/2009 | Kallfass et al. | |
| 2009/0290940 | A1 | 11/2009 | Martin | |
| 2012/0245782 | A1 | 9/2012 | Kawasaki et al. | |
| 2012/0251285 | A1 | 10/2012 | Oyama et al. | |
| 2013/0042935 | A1 | 2/2013 | Post et al. | |
| 2013/0333364 | A1 * | 12/2013 | Carpenter | E02F 9/2203 60/420 |
| 2015/0308081 | A1 * | 10/2015 | Takaura | E02F 3/437 701/50 |
| 2016/0115669 | A1 * | 4/2016 | Gorman | E02F 3/32 701/50 |
| 2016/0160472 | A1 | 6/2016 | Voda et al. | |
| 2016/0186406 | A1 | 6/2016 | Nakagaki et al. | |
| 2016/0251835 | A1 | 9/2016 | Kitajima et al. | |
| 2016/0251836 | A1 * | 9/2016 | Baba | E02F 9/123 701/50 |
| 2016/0281323 | A1 | 9/2016 | Imaizumi | |
| 2017/0121930 | A1 * | 5/2017 | Kitajima | E02F 9/262 |
| 2017/0284057 | A1 * | 10/2017 | Moriki | E02F 9/2041 |
| 2017/0314234 | A1 | 11/2017 | Paull | |
| 2018/0002899 | A1 | 1/2018 | Morimoto | |
| 2018/0112685 | A1 | 4/2018 | Beschorner et al. | |
| 2018/0230671 | A1 * | 8/2018 | Wu | E02F 3/437 |
| 2018/0305898 | A1 | 10/2018 | Kobayashi et al. | |
| 2019/0063041 | A1 * | 2/2019 | Izumi | E02F 9/2066 |
| 2019/0078290 | A1 * | 3/2019 | Yamada | E02F 9/22 |
| 2019/0169818 | A1 * | 6/2019 | Narikawa | E02F 9/20 |
| 2019/0226181 | A1 * | 7/2019 | Imura | E02F 3/435 |
| 2020/0157768 | A1 | 5/2020 | Ito et al. | |

FOREIGN PATENT DOCUMENTS

| | | | |
|---|---|---|---|
| JP | H11-190305 | A | 7/1999 |
| JP | 2000-018209 | A | 1/2000 |
| JP | 2003-194013 | A | 7/2003 |
| JP | 2006265954 | | 10/2006 |
| WO | 2003021365 | A2 | 3/2003 |
| WO | 2012067975 | A2 | 5/2012 |

OTHER PUBLICATIONS

Non-Final Rejection dated Nov. 10, 2021, in connection with U.S. Appl. No. 16/585,662, filed Sep. 27, 2019, 8 pgs. (Year: 2021).*

Final Office Action dated May 1, 2023, in connection with U.S. Appl. No. 16/585,662, filed Sep. 27, 2019, 14 pgs. (Year: 2023).*

Notice of Allowance and Fees Due, dated Aug. 11, 2023, in connection with U.S. Appl. No. 16/585,662, (filed Sep. 27, 2019), 10 pgs. (Year: 2023).*

Shimano et al., "Development of PC210LCi-10/PC200i-10 Machine Control Hydraulic Excavator", Kamatsu Technical Report, 2014, vol. 60, pp. 1-7.

Extended European Search Report dated Jan. 4, 2019, in connection with European Application No. 18190882.3-1018; 8 pages.

International Search Report and Written Opinion dated Nov. 27, 2020, in connection with International Patent Application No. PCT/US2020/047544, filed Sep. 27, 2019, 10 pgs.

International Search Report and Written Opinion mailed in connection with International Patent Application No. PCT/US2020/047683, filed Sep. 27, 2019, 11 pgs.

* cited by examiner

METHOD AND APPARATUS FOR MACHINE OPERATOR COMMAND ATTENUATION

CROSS-REFERENCE TO RELATED APPLICATIONS

This application is a non-provisional application claiming priority to U.S. Provisional Patent Application No. 62/552,058, filed Aug. 30, 2017, the disclosure of which is herein incorporated by reference in its entirety.

BACKGROUND

Construction machines, such as excavators, are often used to modify a surface based on a desired site plan. The site plan typically includes a specification for a desired grade. Material located above the desired grade must be removed. Removal of the material located above the desired grade without digging below the desired grade can be challenging. Users of construction machines often dig below a desired grade due to inexperience or by accident. Experienced users can also unintentionally dig below a desired grade due to a delay in movement of parts of an implement of a construction machine. For example, users often unintentionally dig below a desired grade due to actuation of a stick of an excavating implement prior to actuation of a boom of the excavating implement. Actuation of the stick without actuation of the boom of the construction machine, or a delay in the actuation of the boom due to delays associated with the hydraulic system, can cause the bucket located on the end of the stick to dig below a desired grade before the boom can be moved upward to prevent such digging.

SUMMARY

The present disclosure relates generally to construction machines and, more particularly, to a mode of operation of a construction machine to prevent digging below a desired grade. Digging below the desired grade is prevented by moving a boom of an excavator in response to a requested movement of a stick of the excavator that will cause a bucket of the excavator to dig below the desired grade.

A method for preventing a bucket of an excavator from moving below a desired grade includes determining a position of the bucket. Input requesting movement of a stick of the excavator is received and it is determined whether the requested movement of the stick will cause the bucket to move below the desired grade. In response to determining that the requested movement of the stick will cause the bucket to move below the desired grade, the boom of the excavator is actuated to prevent the bucket from moving below the desired grade. The stick of the excavator is then actuated according to the input requesting movement. In one embodiment, actuating the boom results in an upward movement of the boom according to movement of the boom required to prevent the bucket from moving below the desired grade in response to movement of the stick.

In one embodiment, a current state of a site is determined based on data received by a controller from a plurality of site sensors and a location of the excavator is determined based on location information received by the controller. Determining whether the requested movement of the stick will cause the bucket to move below a desired grade can also be based on the location of the excavator, the current state of the site, and the desired grade. In one embodiment, determining whether the bucket will move below a desired grade is based on an arc the stick will sweep in response to the requested movement and/or an arc the bucket will sweep in response to the requested movement.

DETAILED DESCRIPTION

A method and apparatus for machine operator command attenuation determines whether a user's input to operate a hydraulic implement will cause the implement to modify a surface beyond a desired site plan. For example, the method and apparatus can attenuate and/or override a user's input when such an input would cause an implement of an excavator to dig below a desired grade. Although the description herein refers to digging below a desired grade, it should be understood that the method and apparatus can be applied to any hydraulic implement for modifying a site. Further, the method can be used to prevent a user from modifying a site beyond a desired site plan in any direction (i.e., vertically, horizontally, etc.)

Figure 1:
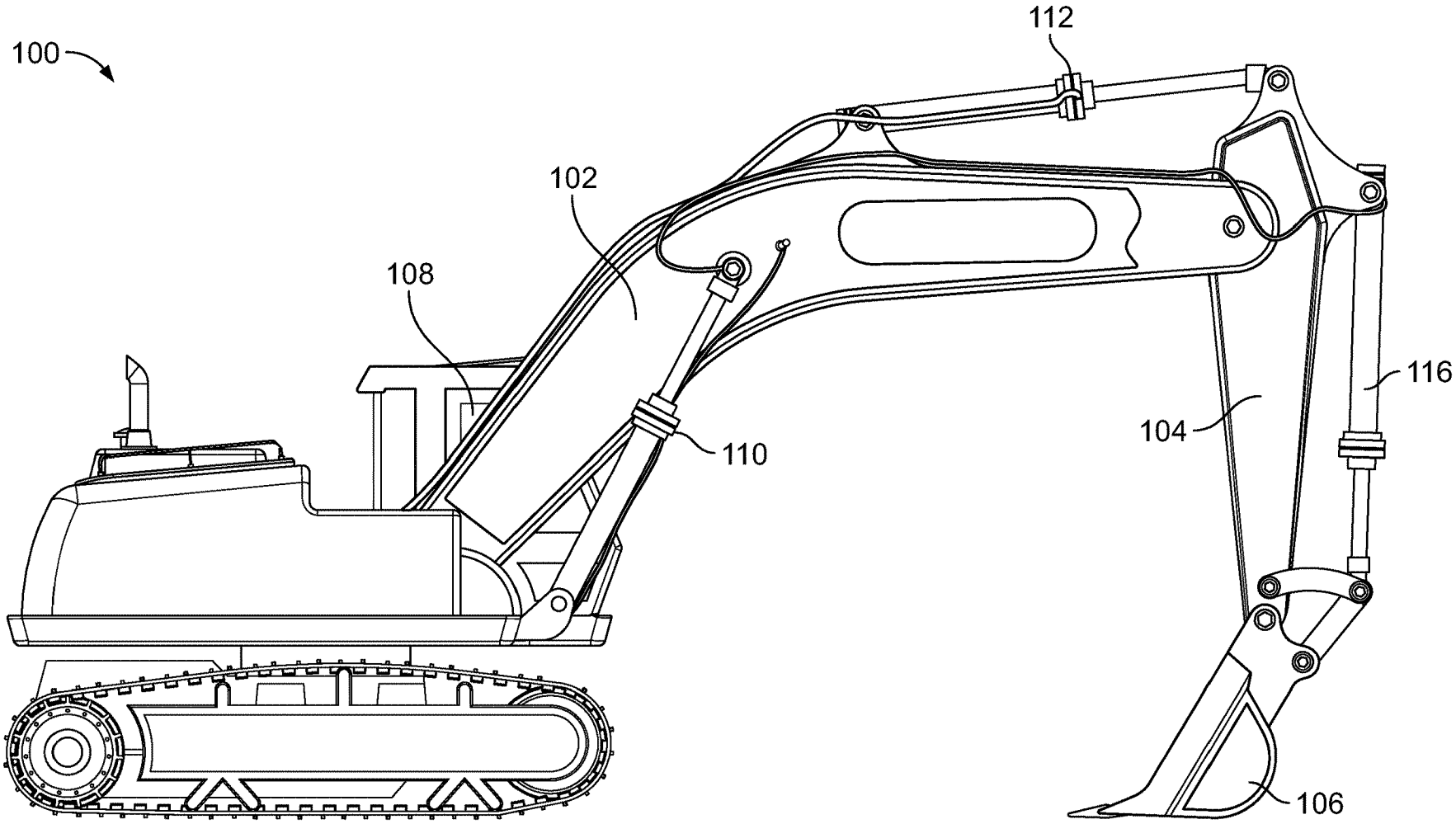
FIG. 1 shows an excavator for modifying a construction site.

FIG. 1 shows a construction machine, specifically, excavator 100. Excavator 100 has an implement comprising boom 102, stick 104, and bucket 106 which are each controlled by a user located in cab 108 of excavator 100. In one embodiment, the user actuates a joystick located in cab 108 to move boom 102 via hydraulic fluid pressure applied to hydraulic cylinder 110. The user actuates another input device to move stick 104 via hydraulic fluid pressure applied to hydraulic cylinder 112. The user actuates an additional user input device to move bucket 106 via hydraulic fluid pressure applied to hydraulic cylinder 116.

Figure 2:
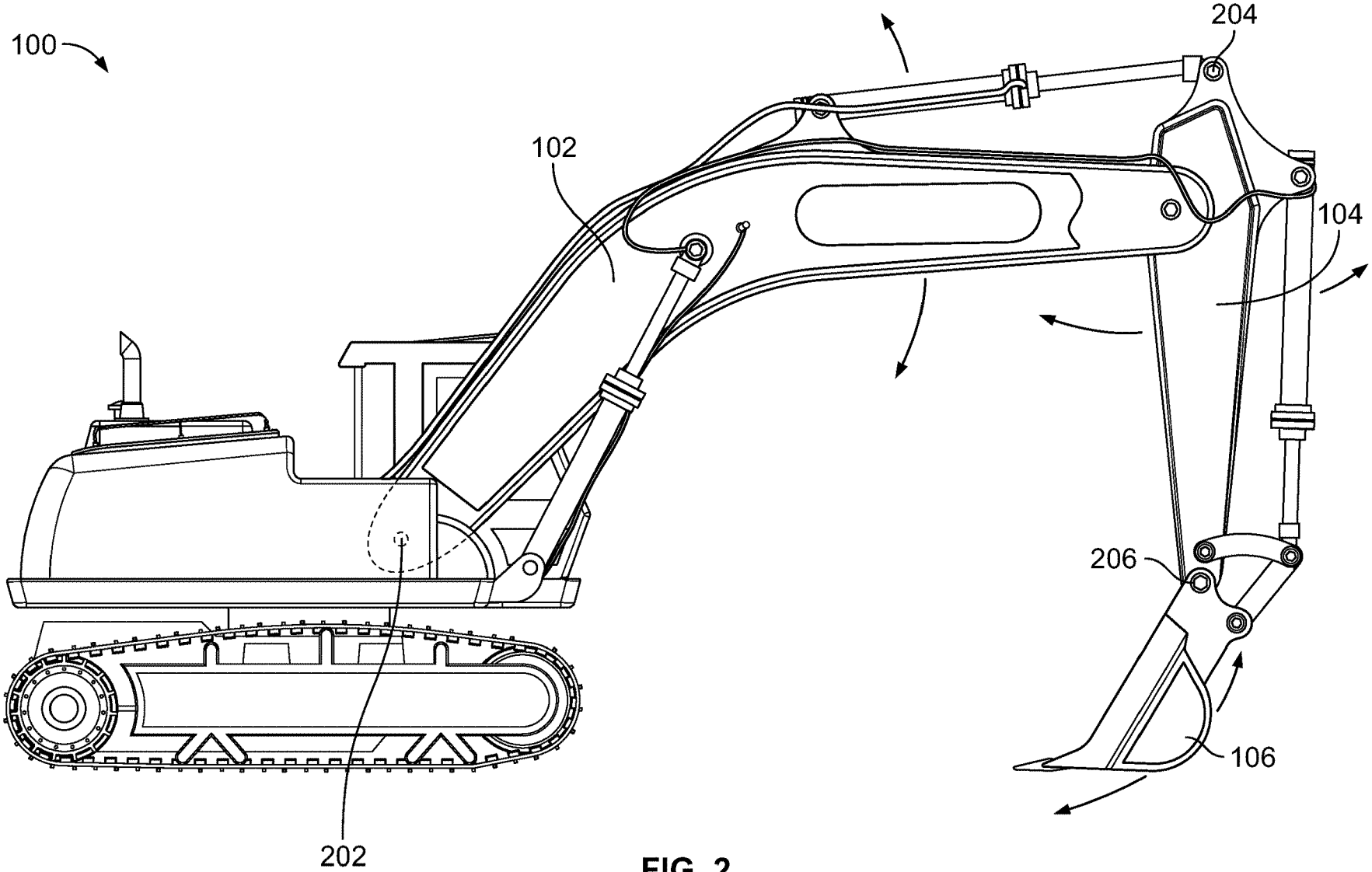
FIG. 2 shows possible movements of an implement of an excavator.

FIG. 2 shows the possible directions of movement of each part of the implement of excavator 100. As shown in FIG. 2, boom 102 can move about pivot 202. As such, boom 102 moves generally toward or away from a surface on which excavator 100 is located. Stick 104 can be moved about pivot 204. As such, stick 104 moves generally toward or away from the main body of excavator 100. Bucket 106 moves about pivot 206. As such, bucket 106 moves generally toward or away from the main body of excavator 100.

Figure 3:
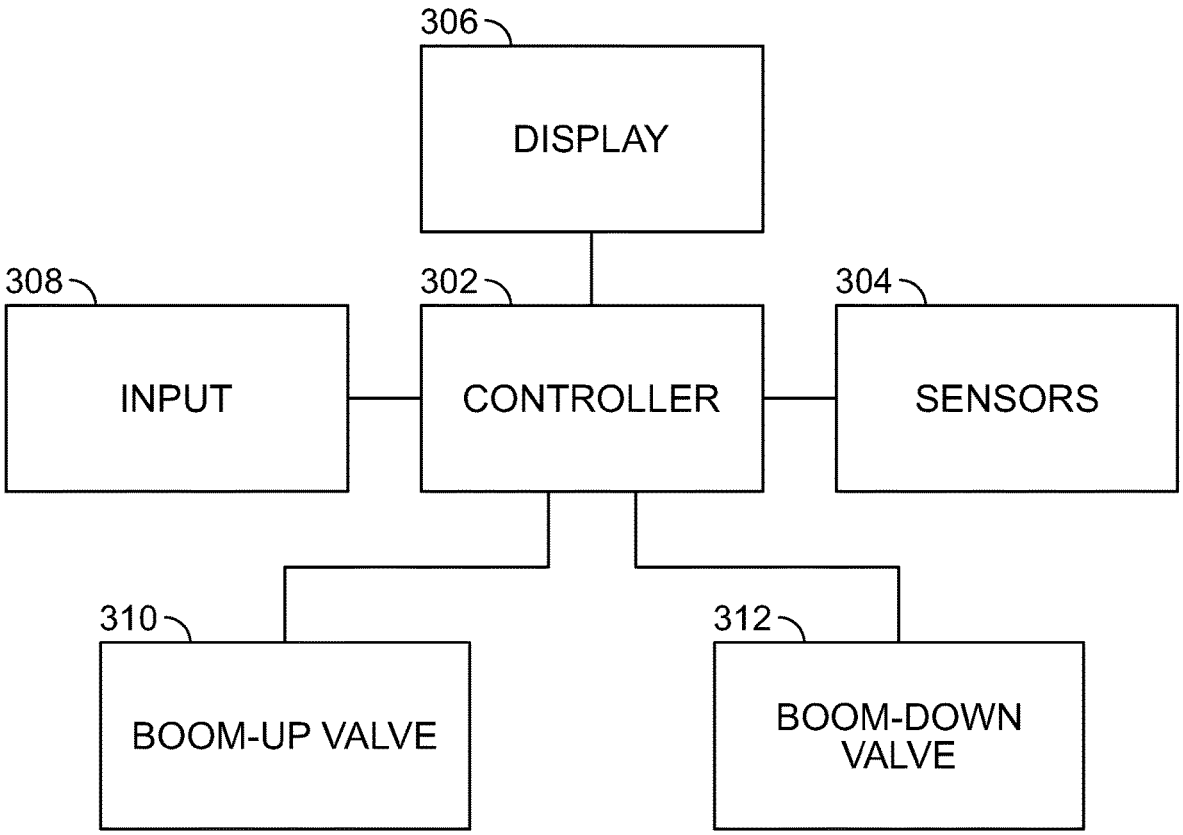
FIG. 3 shows a controller and related components for overriding user inputs to an excavator.

FIG. 3 depicts a schematic of components of excavator 100 related to control of boom 102 according to an embodiment. Controller 302, in one embodiment, is a computer receiving data from sensors 304 which can include one or more sensors for detecting a location and state of excavator 100 including data pertaining to an orientation and location of boom 102, stick 104 and bucket 106. Sensors 304 also include sensors for detecting a current state of a construction site. For example, sensors 304 can include a camera, infrared scanner, or other types of devices for determining a current state of a construction site in which excavator 100 is located. User input is received via input 308. In one embodiment, input 308 can include one or more joysticks for moving boom 102, stick 104, and bucket 106. Display 306 receives data from controller 302 pertaining to information to be displayed to a user. Controller 302 transmits signals to boom-up valve 310 and boom-down valve 312 in order to move boom 102 and also attenuate input from a user via input 308 according to one embodiment.

Figure 4:
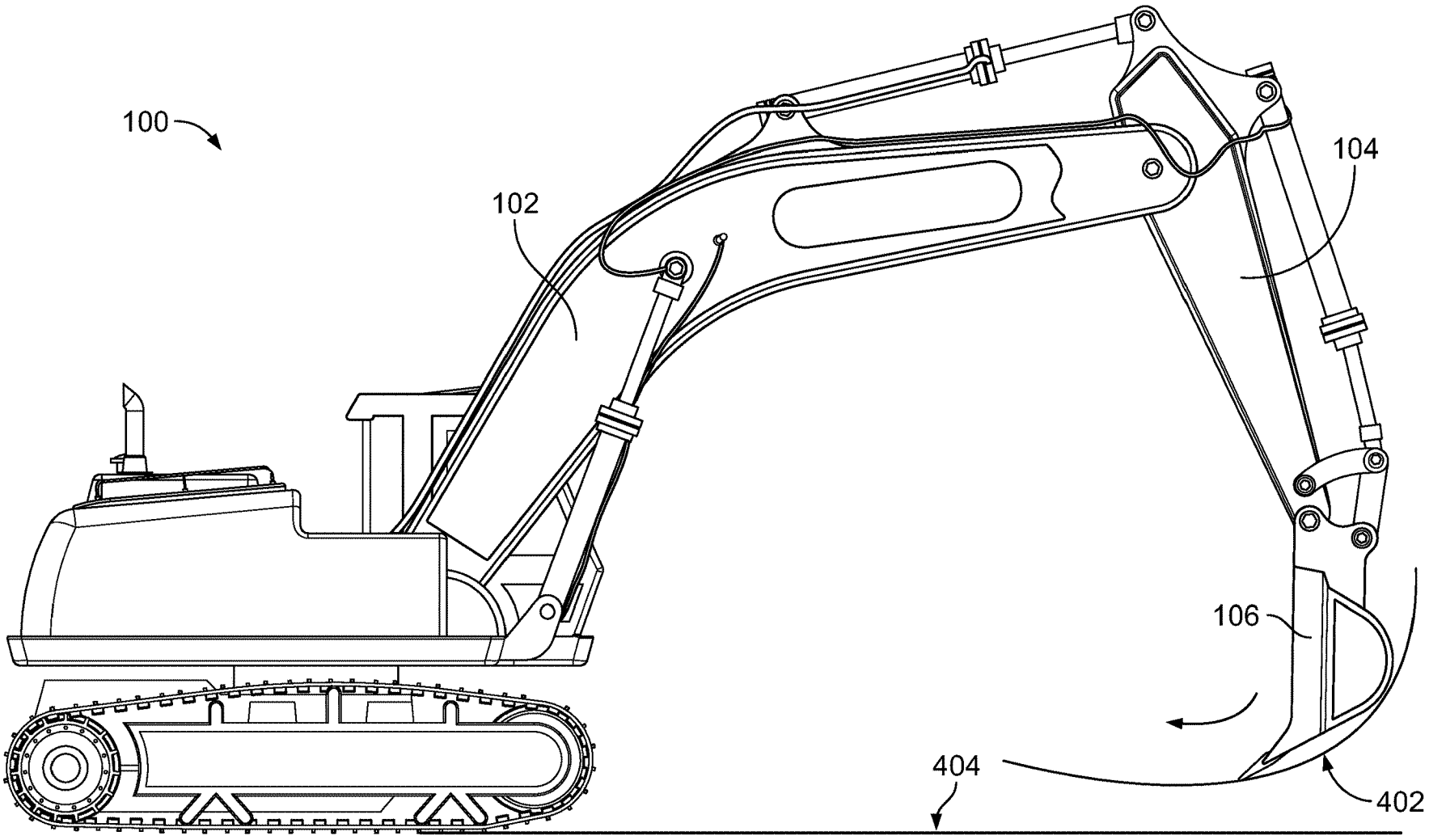
FIG. 4 shows an excavator modifying a construction site.

In one embodiment, controller 302 prevents a user of excavator 100 from digging below a desired grade level. FIG. 4 shows an arc 402 that bucket 106 moves along in response to operator input requesting movement of stick 104. In this example, boom 102 is stationary with respect to excavator 100 and bucket 106 is stationary with respect to stick 104. As shown in FIG. 4, desired grade 404 is located below arc 402. The controller will take no action in response to movement of stick caused by user input since movement of stick 104 cannot cause bucket 106 to remove material below grade 404. In one embodiment, a current state of a construction site is compared to a desired site plan in order to determine whether modification as commanded by a user will cause modification of the site outside of the constraints of the desired site plan.

Figure 5:
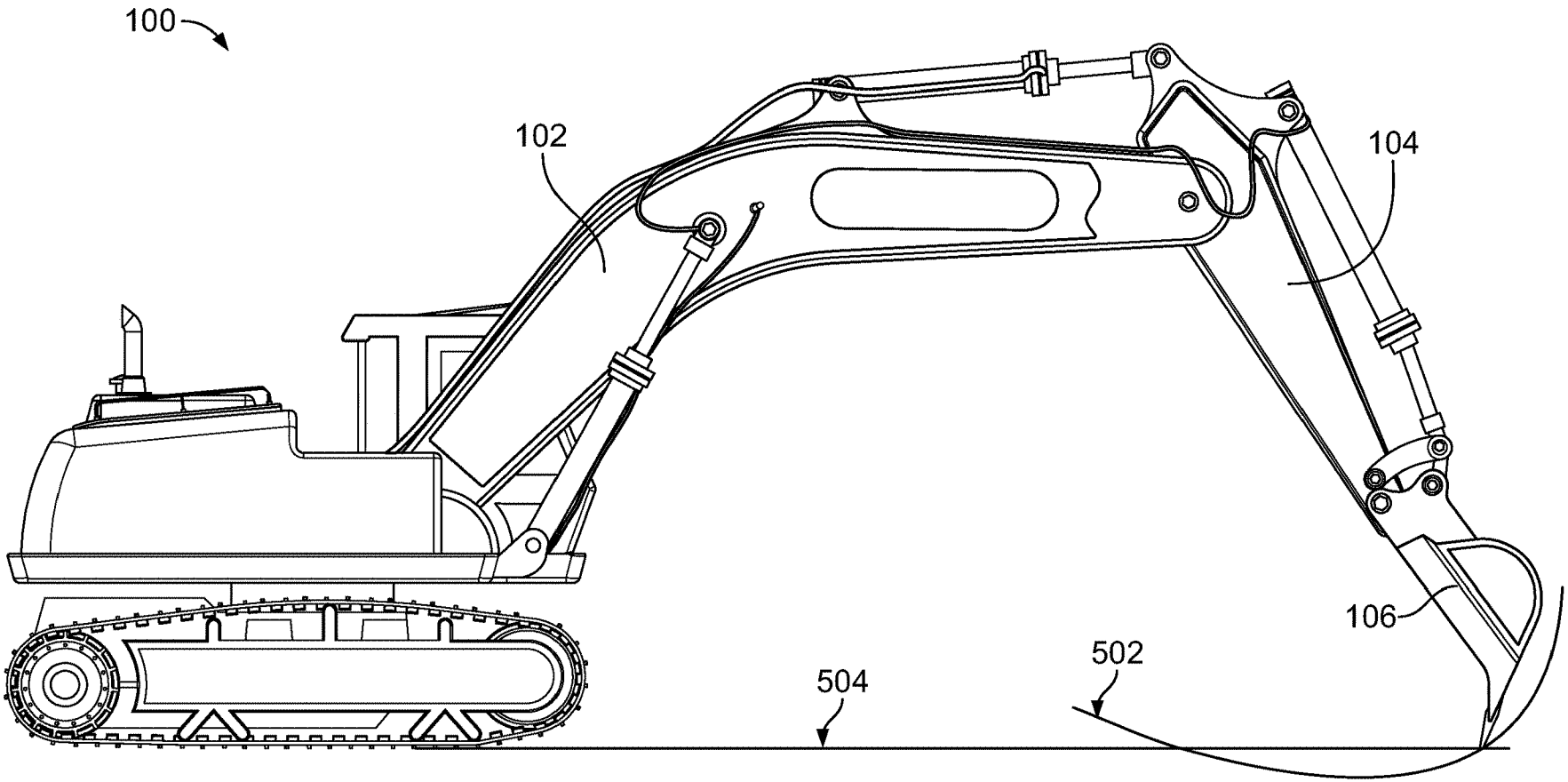
FIG. 5 shows an excavator in the process or modifying a construction site in which the bucket will go below a desired grade.

FIG. 5 shows a bucket sweeping an arc 502 that will go below grade 504 if it is allowed to proceed as per input from a user. Controller 302 determines that allowing bucket 106 to proceed along arc 502 will cause bucket 106 to go below grade 504. In one embodiment, controller 302 determines that bucket 106 will go below grade based on a comparison of how bucket movement will modify the current site compared to a desired site plan. In response to determining that bucket 106 will go below grade 504, controller 302 transmits a signal to boom-up valve 310 which causes boom 102 to move upward. In one embodiment, controller 302 causes boom 102 to move upward a specific distance at which bucket 106 will not go below grade 504. Controller 302 transmits signals to boom-up valve 310 and/or boom-down valve 312 which are part of a hydraulic system for actuating boom 102.

Figure 6:
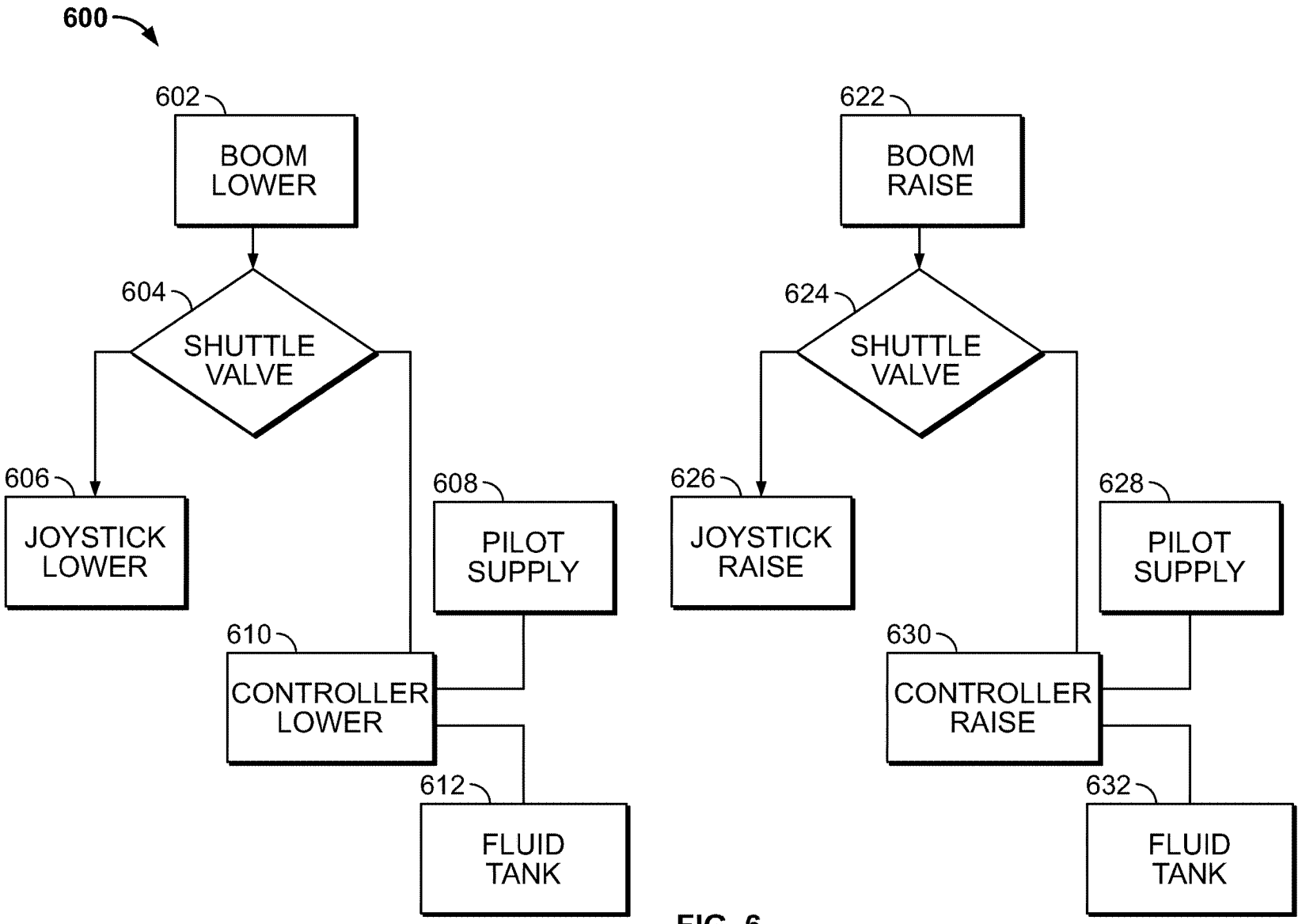
FIG. 6 shows a portion of a hydraulic system of an excavator.

FIG. 6 shows a schematic representing of a portion of a hydraulic system 600 of excavator 100. The portion of hydraulic system 600 shown in FIG. 6 shows the components used to control movement of boom 102. User input is received via joystick input as shown in FIG. 6 as joystick lower 606 and joystick raise 626. A user moves a joystick in order to command boom 102 to lower or raise.

A user inputting joystick lower 606 is commanding boom 102 to lower and causes hydraulic fluid pressure to be applied to shuttle valve 604. The hydraulic fluid pressure applied to shuttle valve 604 causes shuttle valve 604 to apply hydraulic fluid pressure to a hydraulic cylinder attached to boom 102 represented in FIG. 6 by boom lower 602. The hydraulic fluid pressure applied to shuttle valve 604 can be offset by hydraulic fluid pressure applied to shuttle valve 604 by controller lower 610 (referred to as boom-down valve 312 in FIG. 3). Controller lower 610 is an electrically controlled hydraulic valve that receives signals from controller 302. Pilot supply 608 provides hydraulic fluid pressure to controller lower 610. When zero hydraulic fluid pressure is applied by controller lower 610 to shuttle valve 604, hydraulic fluid from pilot supply 608 is directed to fluid tank 612. Controller lower 610 can apply some or all of the hydraulic fluid pressure from pilot supply 608 to shuttle valve 604 in response to signals from controller 302.

A user inputting joystick raise 626 is commanding boom 102 to raise and causes hydraulic fluid pressure to be applied to shuttle valve 624. The hydraulic fluid pressure applied to shuttle valve 624 causes shuttle valve 624 to apply hydraulic fluid pressure to a hydraulic cylinder attached to boom 102 represented in FIG. 6 by boom raise 622. The hydraulic fluid pressure applied to shuttle valve 624 can be offset by hydraulic fluid pressure applied by controller raise 630 (referred to as boom-up valve 310 in FIG. 3). Controller raise 630 is an electrically controlled hydraulic valve that receives signals from controller 302. Pilot supply 628 provides hydraulic fluid pressure to controller raise 630. When zero hydraulic fluid pressure is applied by controller raise 630 to shuttle valve 624, hydraulic fluid from pilot supply 628 is directed to fluid tank 632. Controller raise 630 can apply some or all of the hydraulic fluid pressure from pilot supply 628 to shuttle valve 624 in response to signals from controller 302.

When excavator 100 is operated manually using only user inputs, boom 102 can be lowered or raised using joystick lower 606 and joystick raise 626. When excavator 100 is operated with assistance from controller 302, controller lower 610 and controller raise 630 can apply hydraulic fluid pressure to shuttle valve 604 and/or shuttle valve 624 to attenuate, counteract, and/or override user inputs.

It should be noted that in most applications, hydraulic fluid pressure is applied for one operation. For example, hydraulic fluid pressure can be applied to either raise boom 102 or lower boom 102. Hydraulic fluid pressure is generally not applied to urge boom 102 to raise and lower at the same time. However, the systems and methods described herein can apply a hydraulic fluid pressure to counteract or override user inputs commanding the boom to raise or lower.

Figure 7A:
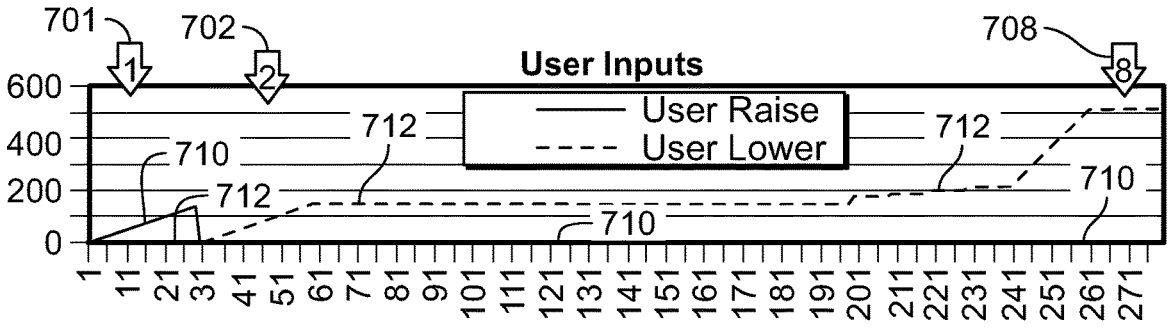
FIGS. 7A-7C show graphs of hydraulic fluid pressure values over time.
Figure 7B:
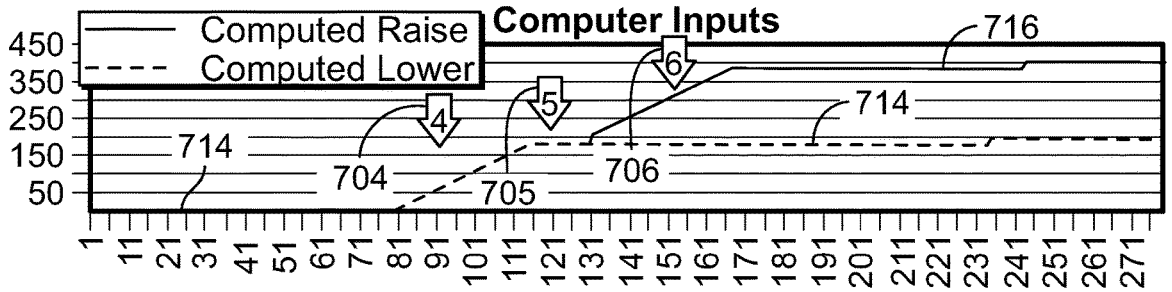
Figure 7C:
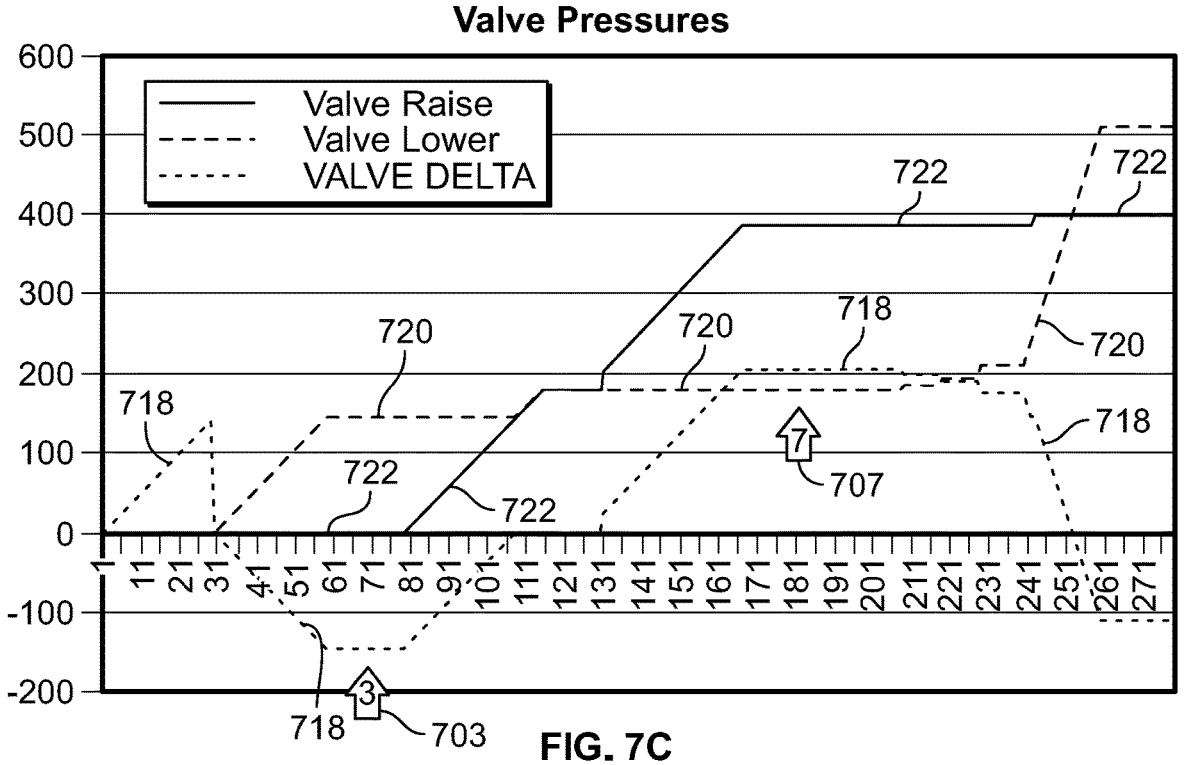

FIGS. 7A-7C depicts graphs of hydraulic fluid pressure over time. FIG. 7A depicts user inputs (e.g., via joystick lower 606 and joystick raise 626 shown in FIG. 6) as pressure values in pounds per square inch ("psi") over time. FIG. 7A depicts hydraulic fluid pressure values associated with user input. FIG. 7B shows hydraulic fluid pressure values associated with and commanded by controller 302. FIG. 7C shows hydraulic fluid pressure values based on boom raise hydraulic fluid pressure values, boom lower hydraulic fluid pressure values, and the combination of the two values.

Referring to FIG. 7A, hydraulic fluid pressure values associated with joystick raise 626 are shown as the line user raise 710 in the graph of FIG. 7A. Hydraulic fluid pressure values associated with joystick lower 606 are shown as the line user lower 712 in the graph of FIG. 7A. Referring to FIG. 7B, hydraulic fluid pressure values associated with controller lower 610 are shown as the line computer lower 714 in the graph of FIG. 7B. Hydraulic fluid pressure values associated with controller raise 630 are shown as the line computer raise 716 in the graph of FIG. 7B. It should be noted that the hydraulic fluid pressure values for both computer raise and computer lower are identical shown in graph 7B until the time of 131 when computer raise 716 ramps up toward 350 psi. Referring to FIG. 7C, the values of hydraulic fluid pressure applied to a valve are shown as well as the result of the combined hydraulic fluid pressure values. Hydraulic fluid pressure values for raising boom 102 are shown as line valve raise 722 in the graph of FIG. 7C. Hydraulic fluid pressure values for lowering boom 102 are shown as line valve lower 720 in the graph of FIG. 7C. The differential hydraulic fluid pressure value based on valve raise 722 and valve lower 720 is shown as line valve delta 718 in the graph of FIG. 7C.

Various events depicted in FIGS. 7A-7C illustrate the operation of the hydraulic system of boom 102 of excavator 100. At event 701 shown in FIG. 7A, hydraulic fluid pressure of the line user raise 710 increases toward 150 psi in response to a user actuating a joystick in the cab of excavator 100 to raise boom 102. At event 702 shown in FIG. 7A, hydraulic fluid pressure of the line user lower 712 increases toward 150 psi in response to the user actuating the joystick in the cab of excavator 100 to lower boom 102. At event 703 shown in FIG. 7C, the difference between the values of valve raise 722 and valve lower 720 are shown as valve delta 718 which is −150 psi at event 703. Boom 102 lowers at event 703 caused by the valve delta 718 being −150 psi.

At event 704 shown in FIG. 7B, controller 302 causes hydraulic fluid pressure values of both line computer raise 716 and line computer lower 714 to increase toward 150 psi as shown in FIG. 7B. At event 705 shown in FIG. 7B, the hydraulic fluid pressure values of both line computer raise 716 and line computer lower 714 are 150 psi. This locks boom 102 in its current position by preventing any user input that will cause less than 150 psi hydraulic fluid pressure from being applied and moving boom 102 unless the user input commands a hydraulic fluid pressure above 150 psi. User inputs commanding greater than 150 psi will cause boom 102 to move since the hydraulic fluid pressure in response to user input is greater than 150 psi.

At event 706 shown in FIG. 7B, controller 302 commands boom 102 to raise by applying hydraulic fluid pressure as shown by line computer raise 716 increasing toward a value greater than 350 psi. As shown at event 707 shown in FIG. 7C, valve delta 718 has a value of approximately 200 psi based on the difference between the values of valve raise 722 and valve lower 720 at event 707. Accordingly, since valve delta 718 is approximately 200 psi, boom 102 is raised. At event 708 shown in FIG. 7A, user input overrides the command to lower boom 102 by controller 302. As shown at event 708, the hydraulic fluid pressure value of user lower 712 is over 500 psi. The large user input overrides the command to raise boom 102 from controller 302 and boom 102 lowers.

FIGS. 7A-7C illustrate the effect of hydraulic fluid pressures based on controller 302 commands and user inputs via a joystick located in the cab of excavator. As illustrated in FIGS. 7A-7C, controller 302 can attempt to override user inputs to prevent movement of boom 102. In one embodiment, user input can override controller 302 commands (for example, at event 708 where user input causes a hydraulic fluid pressure of approximately 500 psi). This allows a user to override movement of boom 102 by controller 302 when the user desires.

In one embodiment, control of the movement of boom 102 by controller 302 is used to prevent a user from digging below a desired grade as described above in connection with FIGS. 4 and 5.

Figure 8:
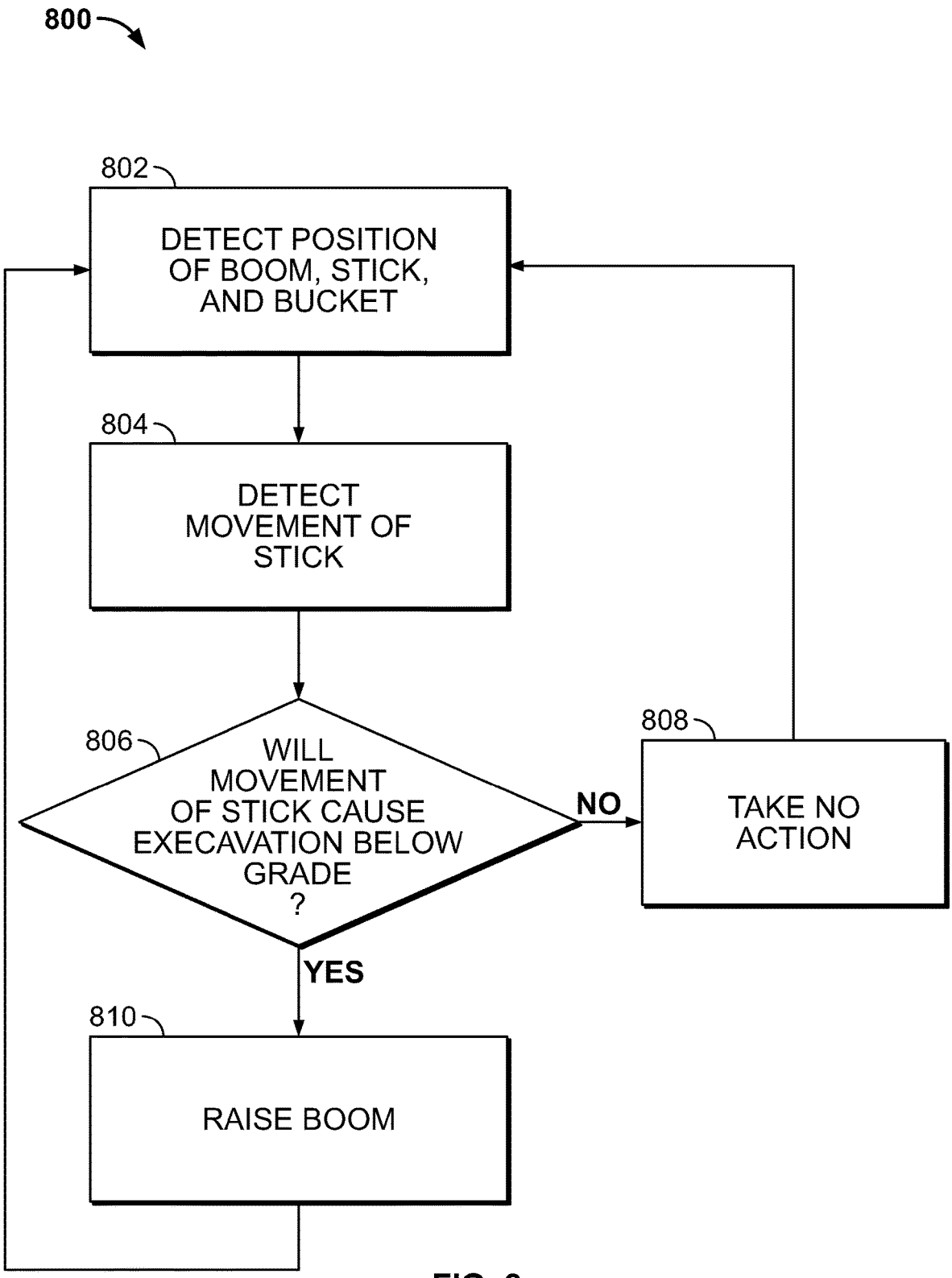
FIG. 8 shows a flow chart of a method for overriding user inputs to an excavator according to an embodiment.

FIG. 8 shows a flow chart of a method 800 according to one embodiment for preventing a user from using excavator 100 to excavator (e.g., dig) below a desired grade. At step 802, controller 302 (shown in FIG. 3) determines the position of boom 102, stick 104, and bucket 106. The positions, in one embodiment, are determined based on data from sensors 304 (shown in FIG. 3). At step 804, controller 302 detects movement of stick 104 based on data from sensors 304. Controller 302 can also receive user input requesting movement of stick 104 of excavator 100. In one embodiment, controller 302 receives input requesting movement of stick 104 from a device, such as a joystick. At step 806, controller 302 determines if movement of stick 104 will cause excavation below a desired grade. In one embodiment, excavation below a desired grade can occur when bucket 106 is moved below the desired grade. In one embodiment, controller 302 compares the effect movement of stick 104 will have on the current states of a construction site to a desired site plan. If movement of stick 104 will not result in excavation below a desired grade, the method proceeds to step 808, controller 302 takes no action, and the method returns to step 802 and the process is repeated. If controller 302 at step 806 determines that movement of stick 104 will cause excavation below a desired grade, the method proceeds to step 810 and controller 302 commands (e.g. actuates) boom 102 to raise an amount determined to prevent excavation below the desired grade (e.g., prevents movement of bucket below desired grade). In one embodiment, controller 302 causes boom 102 to raise by applying hydraulic fluid pressure to shuttle valve 624 via actuation of controller raise 630. The method proceeds to step 802 and the process is repeated.

In one embodiment, stick 104 is actuated according to input requesting movement of the stick of the excavator after boom 102 has been actuated to prevent bucket 106 from moving below the desired grade. Actuation of boom 102, in one embodiment, results in an upward movement of boom 102 according to movement of the boom required to prevent bucket 106 from moving below a desired grade in response to movement of stick 104.

In one embodiment, determining whether requested movement of stick 104 will cause bucket 106 to move below a desired grade is based on a location of excavator 100 and a current state of a site in which excavator 100 is located. The current state of the site is determined, in one embodiment, by controller 302 based on data received from a plurality of site sensors. The location of excavator 100 is determined, in one embodiment, based on location information received from a location determination device, such as a global positioning system receiver.

Determining whether the requested movement of stick 104 will cause bucket 106 to move below a desired grade is determined, in one embodiment, based on an arc that the stick will sweep as it is moved. As shown in FIGS. 4 and 5, movement of stick 104 is around a pivot point where stick 104 attaches to boom 102. Movement of stick 104 causes bucket 106 to also move along an arc. The arc that stick 104 will sweep, in one embodiment, is determined based on the position of boom 102. Determination of the arc that stick 104 will sweep can be used to determine an arc that bucket 106 will sweep. The arc stick 104 will sweep and/or the arc bucket 106 will sweep can be compared to a desired grade to determine whether bucket 106 will move below the desired grade based on the position of boom 102, sweep of stick 104 through it arc in response to a requested movement by a user, and the position of bucket 106.

It should be noted that the system of computer control, attenuation and/or override of user inputs can be used for any hydraulic implement or parts of a hydraulic implement. For example, the system of computer control, attenuation and/or and override of user inputs can be used with stick 104 and bucket 106 of excavator 100.

Figure 9:
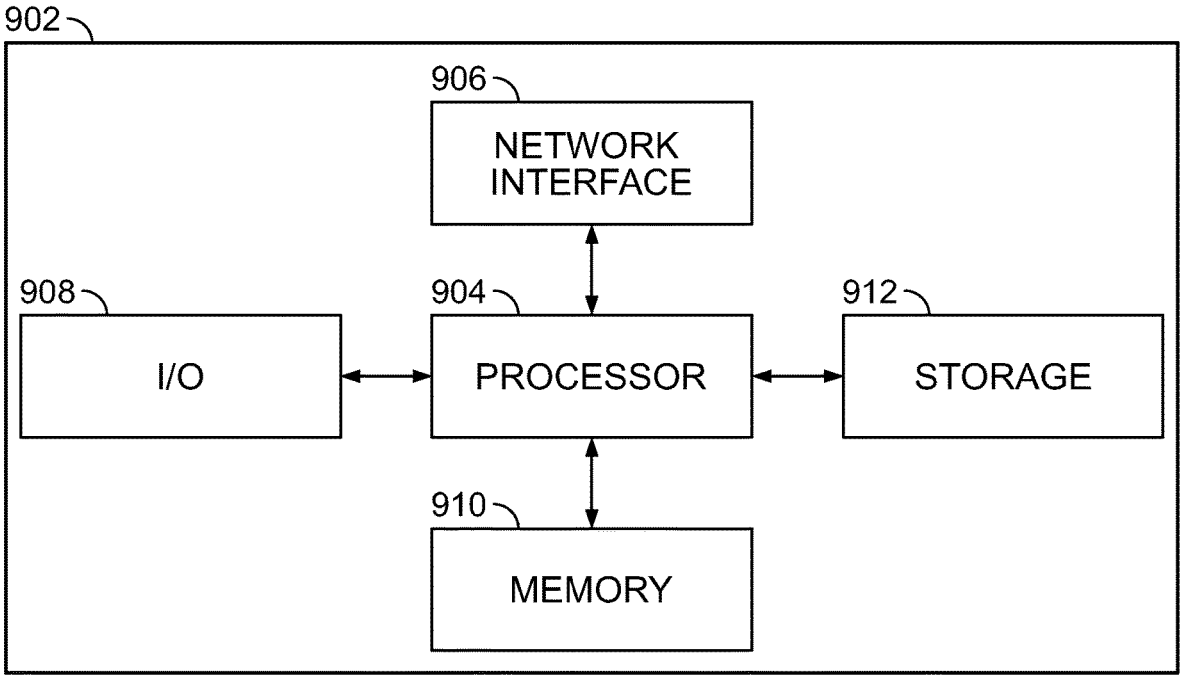
FIG. 9 shows a computer used to implement a hydraulic controller according to an embodiment.

In one embodiment, controller 302 can be implemented using a computer. A high-level block diagram of such a computer is illustrated in FIG. 9. Computer 902 contains a processor 904 which controls the overall operation of the computer 902 by executing computer program instructions which define such operation. The computer program instructions may be stored in a storage device 912, or other computer readable medium (e.g., magnetic disk, CD ROM, etc.), and loaded into memory 910 when execution of the computer program instructions is desired. Thus, the method steps of FIG. 3 can be defined by the computer program instructions stored in the memory 910 and/or storage 912 and controlled by the processor 904 executing the computer program instructions. For example, the computer program instructions can be implemented as computer executable code programmed by one skilled in the art to perform an algorithm defined by the method steps of FIG. 8. Accordingly, by executing the computer program instructions, the processor 904 executes an algorithm defined by the method steps of FIG. 8. The computer 902 also includes one or more network interfaces 906 for communicating with other devices via a network. The computer 902 also includes input/output devices 908 that enable user interaction with the computer 902 (e.g., display, keyboard, mouse, speakers, buttons, etc.) One skilled in the art will recognize that an implementation of an actual computer could contain other components as well, and that FIG. 9 is a high level representation of some of the components of such a computer for illustrative purposes.

The foregoing Detailed Description is to be understood as being in every respect illustrative and exemplary, but not restrictive, and the scope of the inventive concept disclosed herein is not to be determined from the Detailed Description, but rather from the claims as interpreted according to the full breadth permitted by the patent laws. It is to be understood that the embodiments shown and described herein are only illustrative of the principles of the inventive concept and that various modifications may be implemented by those skilled in the art without departing from the scope and spirit of the inventive concept. Those skilled in the art could implement various other feature combinations without departing from the scope and spirit of the inventive concept.

What is claimed is:

1. A method for operating an excavator controller, the method comprising:

determining a position of a bucket of an excavator;

receiving input requesting movement of a stick of the excavator;

determining whether the requested movement of the stick will cause the bucket to move below a desired grade based on an arc the stick will sweep in response to the input requesting the movement of the stick; and in response to determining that the requested movement of the stick will cause the bucket to move below the desired grade:

determining an amount to raise a boom of the excavator to prevent the bucket from moving below the desired grade in response to movement of the stick;

preventing movement of the stick prior to raising the boom by applying opposing hydraulic pressures to a hydraulic cylinder connected to the stick at a value greater than a hydraulic pressure applied to the hydraulic cylinder caused by the input requesting movement of the stick;

raising the boom of the excavator the determined amount; and actuating the stick of the excavator in response to the requested movement of the stick after the raising of the boom.

2. The method of claim 1, further comprising:

receiving data from a plurality of site sensors;

receiving excavator location information;

determining a current state of the site based on the data from the plurality of site sensors; and determining a location of the excavator on the site based on the excavator location information, wherein the determining whether the requested movement of the stick will cause the bucket to move below the desired grade is further based on the location of the excavator, the current state of the site, and the desired grade.

3. The method of claim 2, wherein the determining whether the requested movement of the stick will cause the bucket to move below the desired grade is further based on a comparison between the arc the stick will sweep in response to the input requesting the movement of the stick and the desired grade.

4. The method of claim 3, wherein the arc the stick will sweep in response to the input requesting movement of the stick is determined based on a position of the boom and a position of the bucket.

5. An apparatus comprising:

a processor; and a memory to store computer program instructions, the computer program instructions when executed on the processor cause the processor to perform operations comprising:

determining a position of a bucket of an excavator;

receiving input requesting movement of a stick of the excavator;

determining whether the requested movement of the stick will cause the bucket to move below a desired grade based on an arc the stick will sweep in response to the input requesting the movement of the stick; and in response to determining that the requested movement of the stick will cause the bucket to move below the desired grade:

determining an amount to raise a boom of the excavator to prevent the bucket from moving below the desired grade in response to movement of the stick;

preventing movement of the stick prior to raising the boom by applying opposing hydraulic pressures to a hydraulic cylinder connected to the stick at a value greater than a hydraulic pressure applied to the hydraulic cylinder caused by the input requesting movement of the stick;

raising the boom of the excavator the determined amount; and actuating the stick of the excavator in response to the requested movement of the stick after the raising of the boom.

6. The apparatus of claim 5, the operations further comprising:

receiving data from a plurality of site sensors;

receiving excavator location information;

determining a current state of the site based on the data from the plurality of site sensors; and determining a location of the excavator on the site based on the excavator location information, wherein the determining whether the requested movement of the stick will cause the bucket to move below the desired grade is further based on the location of the excavator, the current state of the site, and the desired grade.

7. The apparatus of claim 6, wherein the determining whether the requested movement of the stick will cause the bucket to move below the desired grade is further based on a comparison between the arc the stick will sweep in response to the input requesting the movement of the stick and the desired grade.

8. The apparatus of claim 7, wherein the arc the stick will sweep in response to the input requesting movement of the stick is determined based on a position of the boom and a position of the bucket.

9. A computer readable storage device storing computer program instructions, which, when executed on a processor, cause the processor to perform operations comprising:

determining a position of a bucket of an excavator;

receiving input requesting movement of a stick of the excavator;

determining whether the requested movement of the stick will cause the bucket to move below a desired grade based on an arc the stick will sweep in response to the input requesting the movement of the stick; and in response to determining that the requested movement of the stick will cause the bucket to move below the desired grade:

determining an amount to raise a boom of the excavator to prevent the bucket from moving below the desired grade in response to movement of the stick;

preventing movement of the stick prior to raising the boom by applying opposing hydraulic pressures to a hydraulic cylinder connected to the stick at a value greater than a hydraulic pressure applied to the hydraulic cylinder caused by the input requesting movement of the stick;

raising the boom of the excavator the determined amount; and actuating the stick of the excavator in response to the requested movement of the stick after the raising of the boom.

10. The computer readable storage device of claim 9, the operations further comprising:

receiving data from a plurality of site sensors;

receiving excavator location information;

determining a current state of the site based on the data from the plurality of site sensors; and determining a location of the excavator on the site based on the excavator location information, wherein the determining whether the requested movement of the stick will cause the bucket to move below the desired grade is further based on the location of the excavator, the current state of the site, and the desired grade.

11. The computer readable storage device of claim 10, wherein the determining whether the requested movement of the stick will cause the bucket to move below the desired grade is further based on a comparison between the arc the stick will sweep in response to the input requesting the movement of the stick and the desired grade.

* * * * *